United States Patent [19]

Hosaka

[11] Patent Number: 5,067,435

[45] Date of Patent: Nov. 26, 1991

[54] TONER DENSITY SENSOR IN CLOSE PROXIMITY TO THE REGULATING BLADE

[75] Inventor: Akihito Hosaka, Yokohama, Japan

[73] Assignee: Canon Kabushiki Kaisha, Tokyo, Japan

[21] Appl. No.: 575,680

[22] Filed: Aug. 31, 1990

[30] Foreign Application Priority Data

Aug. 31, 1989 [JP] Japan ..... 1-225374

[51] Int. Cl.[5] ..... G03G 15/08

[52] U.S. Cl. ..... 118/653; 355/208; 355/246

[58] Field of Search ..... 355/246, 251, 253, 208; 222/DIG. 1; 118/656, 657, 689, 690, 691, 653

[56] References Cited

U.S. PATENT DOCUMENTS

| | | | |
|---|---|---|---|
| 3,757,999 | 9/1973 | Maksymiak | 222/DIG. 1 X |
| 4,395,476 | 7/1983 | Kanbe et al. | 430/102 |
| 4,504,136 | 3/1985 | Yoshikawa et al. | 355/253 |
| 4,550,998 | 11/1985 | Nishikawa | 118/691 |
| 4,601,259 | 7/1986 | Yamashita | 355/260 X |
| 4,739,365 | 4/1988 | Hino | 355/246 |
| 4,933,254 | 6/1990 | Hosoi et al. | 430/122 |
| 4,985,823 | 1/1991 | Tada et al. | 346/160.1 |

*Primary Examiner*—A. T. Grimley
*Assistant Examiner*—J. E. Barlow, Jr.
*Attorney, Agent, or Firm*—Fitzpatrick, Cella, Harper & Scinto

[57] ABSTRACT

A developing apparatus is provided with a developer bearing member for bearing developer including toner particles and carrier particles to feed the developer to a developing station. A regulating member is disposed in confronting relation to the developing bearing member and adapted to regulate an amount of the developer fed to the developing station. A voltage source outputs an alternating bias voltage to the developer bearing member and to the regulating member. A detecting element is disposed in the vicinity of the regulating member and in confronting relation to the developing bearing member. The detecting element is adapted to detect toner density in the developer born by the developer bearing member. An electrical shield member is disposed between the detecting member and the regulating member.

9 Claims, 2 Drawing Sheets

TONER DENSITY SENSOR IN CLOSE PROXIMITY TO THE REGULATING BLADE

BACKGROUND OF THE INVENTION

1. Field of the Invention

The present invention relates to a developing apparatus for an electrostatic latent image, used with a copying machine, printer, facsimile, displaying system and the like.

2. Related Background Art

In a developing apparatus using two-component developer including carrier particles and toner particles, since the toner particles are used during each developing cycle, the toner density in the developer is gradually decreased as the developing cycles increase. In order to keep the toner density in the developer at a constant value, the toner density in the developer being used in the developing apparatus must always be detected exactly and new toner particles must be replenished on the basis of the detection result.

Therefore, in order to detect the toner density in the developer being used in the developing apparatus, Japanese Patent Laid-Open No. 53-107853 and U.S. Pat. No. 4,985,823 disclose a developing apparatus as shown in FIG. 1.

In FIG. 1, the reference numeral 1 denotes an electrophotographic photosensitive drum rotating in a direction shown by the arrow A; reference numeral 2 denotes a magnet roller arranged in parallel with the photosensitive drum 1; reference numeral 3 denotes a developing sleeve rotatably mounted around the magnet roller 2 and rotated in a direction B in synchronism with the photosensitive drum 1 by means of a driving mechanism (not shown); reference numeral 4 denotes a developer container for containing developer D consisting of toner particles and magnetic carrier particles; reference numeral 5 denotes a screw-type agitator for agitating the developer D in the developer container 4; reference numeral 6 denotes a toner replenishing bath for containing toner particles T to be replenished into the developer container 4; reference numeral 7 denotes a screw feeder for replenishing the toner particles T in the toner replenishing bath 6 into the developer container 4; and reference numeral 8 denotes a motor for rotating the screw feeder 7.

A toner density sensor 9 has the following elements 9*a*–9*e*. The reference numeral 9*a* denotes a body of the toner density sensor 9 having a transparent glass window 9*b* disposed above the developing sleeve 3 and extending in a tangential direction (horizontal direction) to the developing sleeve 3; 9*c* denotes a light emitting elements such as an infrared ray LED; and 9*e* denotes a light receiving element. The reference numeral 10 denotes a control circuit for the light emitting element; reference numeral 11 denotes a differential amplifier; and reference numeral 12 denotes a reference value generator (reference voltage source).

In the arrangement shown in FIG. 1, when the developer adhered on the developing sleeve 3 reaches below the toner density sensor 9, the infrared ray emitted from the light emitting element 9*c* is illuminated on the developer through the transparent glass window 9*b*. The light reflected by the developer on the developing sleeve 3 is received through an infrared ray permeable filter 9*d* by the light receiving element 9*e*, where the light is converted into an electrical signal. The electrical signal is compared with the reference value in the differential amplifier 11, and the signal is amplified by the difference between the signal value and the reference value. The amplified signal is used as a control signal for driving the motor 8.

By the way, a developing apparatus which can reduce or suppress the deterioration of the image due to the sweeping traces by means of the magnetic brush and/or deterioration of toner particles has been proposed, for example, as disclosed in U.S. Pat. No. 4,933,254. In this developing apparatus, the two-component developer consisting of the toner particles and the magnetic carrier particles is born on the developing sleeve as a thin layer, and the electrostatic latent image formed on the photosensitive member is brought into the developing station. And, the developing efficiency is improved by applying the AC bias voltage superimposing the DC voltage to the developing sleeve, and the alternate electric field is generated in the developing station in order to obtain an image having high quality. Incidentally, a toner layer regulating blade is arranged in the vicinity of the developing sleeve for forming the thin developer layer on the developing sleeve. When the AC bias voltage is applied to the developing sleeve, the flying of the toner is caused at the position of the regulating blade and the discharge phenomenon at high peak value is generated. In order to eliminate such inconvenience, the AC bias voltage same as that applied to the developing sleeve must also be applied to the regulating blade, as disclosed in U.S. Pat. No. 4,395,476.

On the other hand, since the change in the toner density leads in the deterioration of the image quality regarding the image density and/or the fog in the image, in order to control the image quality precisely, it is desirable that the toner density sensor is disposed so as to detect the toner density in the developer at a position near the developing station where the toner is supplied to the latent image. To achieve this, it is preferable that the toner density sensor is arranged in the vicinity of the toner layer regulating blade (the toner passing through this blade can reach the developing station). However, if the toner density sensor is arranged in the vicinity of the regulating blade, under the influence of the AC bias voltage, a dielectric current is generated in the electric signal from the toner density sensor, thus causing the noise and not providing the correct detection signal. As a result, it was impossible to control the toner density correctly, thereby causing the deterioration of the image quality.

SUMMARY OF THE INVENTION

An object of the present invention is to provide a developing apparatus which can provide a developed image having high quality.

Another object of the present invention is to provide a developing apparatus wherein as AC bias voltage is applied to a developer bearing member and which can provide a toner density detection signal with high accuracy.

Other objects and features of the present invention will be apparent from the following descriptions.

DETAILED DESCRIPTION OF THE PREFERRED EMBODIMENT

Figure 2:
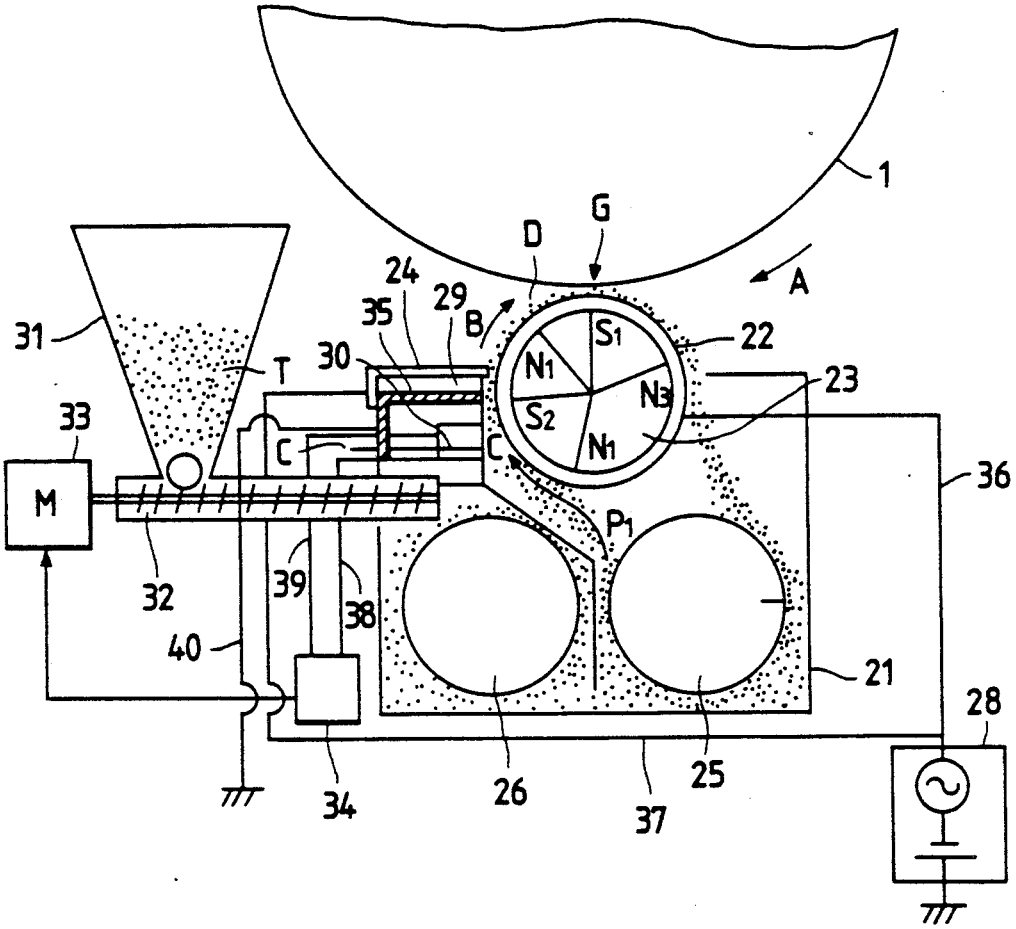
FIG. 2 is a sectional constructural view of a developing apparatus according to a preferred embodiment of the present invention.

In FIG. 2, the reference numeral 1 denotes an electrophotographic photosensitive drum (electrostatic latent image bearing member) rotating in a direction shown by the arrow A. The reference numeral 22 denotes a developing sleeve (developer bearing member) made of nonmagnetic conductive material such as alminium, stainless steel and the like and rotated in a direction B; reference numerals 23 denotes a magnet roller fixed within the developing sleeve 22; reference numeral 21 denotes a developer container for containing developer D; reference numerals 25 and 26 denote screw-type agitators; reference numeral 24 denotes a regulating blade (developer regulating member) made of a conductive metal material such as stainless steel, iron or the like for controlling a thickness of a layer of the developer D adhered to the developing sleeve 22 and sent to a developing station where a distance between the photosensitive drum 1 and the developing sleeve 22 is 1 mm or less; reference numeral 29 denotes a compression member arranged adjacent the regulating blade 24 for compressing the developer to be fed to the regulating blade 24 to a predetermined density; and reference numeral 30 denotes a toner density sensor embedded in the compression member 29 as described in the above-mentioned U.S. Pat. No. 4,985,823. The elements 22, 23, 24, 25, 26, 29 and 30 are disposed in or on the developer container 21.

The reference numeral 28 denotes a developing bias voltage source for applying an AC developing bias voltage adding a DC voltage to the developing sleeve 22, an output AC voltage of which is applied to the developing sleeve 22 through a lead wire 36 and to the regulating blade 24 through a lead wire 37. By applying the AC voltage to the developing sleeve 22, an alternating electric field a, direction of which is changed alternately, is generated at the developing station G. Due to the alternating electric field, the toner particles in the developer layer is attracted to an image area of the latent image. Incidentally, the peak-to-peak value (voltage between peaks) Vpp of the AC bias voltage is greater than an absolute value of the difference between the potential of the image area of the latent image (area on which the toner is to be attracted) and the potential of a non-image area of the latent image (area on which the toner is not to be attracted), i.e., the potential contrast of the latent image, and is normally 0.5~3 KV. Further, the DC voltage to be added to the AC bias voltage has a value between the potential value of the image area of the latent image and the potential value of the non-image area of the latent image. In addition, the frequency of the AC bias voltage is 0.5~3 KHz.

The reference numeral 31 denotes a hopper for containing the toner particles T to be replenished into the developer container 21; reference 32 denotes a screw feeder for feeding the toner particles from the hopper 31 to the developer container 21; and reference 33 denotes a motor for driving the screw feeder 32.

Figure 1:
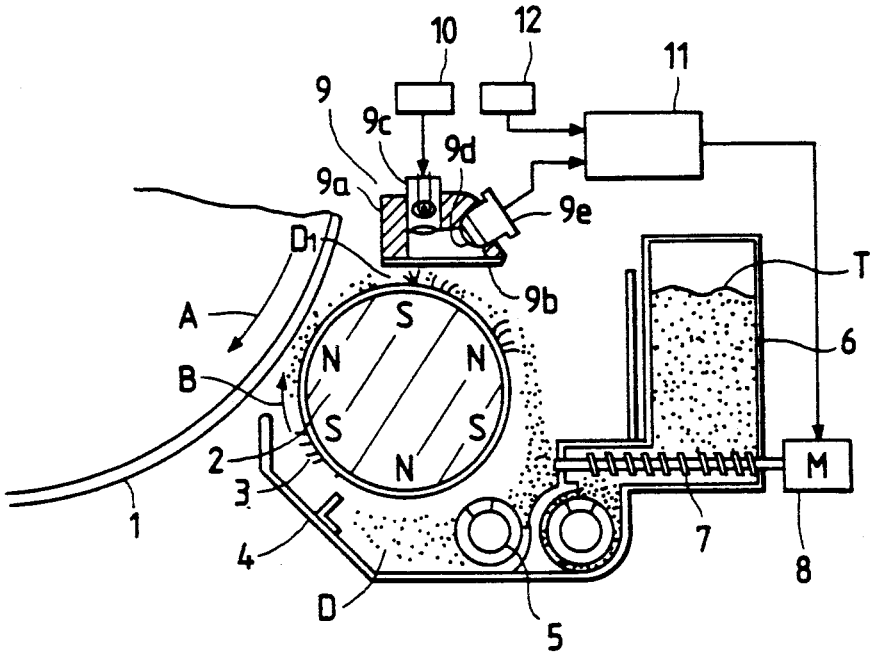
FIG. 1 PRIOR ART
FIG. 1 is a sectional constructural view of a conventional developing apparatus.

The reference numeral 34 denotes a control circuit such as the differential amplifier 11 as shown in FIG. 1, for comparing the toner density signal from the toner density sensor 30 with the reference signal and for energizing the motor 33 to feed the toner particles T from the hopper 31 to the developer container 21 when the toner density is below the reference value. An output signal from a first light receiving element (described later) is sent to the control circuit as the toner density signal through a lead wire 38, and an output signal from a second light receiving element (described later) is also sent as the reference signal through a lead wire 39.

In the apparatus shown in FIG. 2, when the developing sleeve 22 is rotated in the direction B, the developer D in the developer container 21 is attracted to the developing sleeve 22 by the magnetic attraction force of the magnet roller 23 arranged in the developing sleeve 22, and is lifted through the clearance between the sleeve 22 and the compression member 29 in a direction shown by $P_1$ as the sleeve is rotated. Thereafter, the developer layer having a thickness corresponding to the clearance between an outer surface of the developing sleeve 22 and the free end of the regulating blade 24 is fed out of the developer container 21 and is brought into the developing station G.

The developer transported toward the developing section with the rotation of the developing sleeve 22 is forced into a gap defined between the regulator 24 and developing sleeve 22, to be transported as a dense stream and quickly.

On the other hand, the toner replenished into the developer container 21 is mixed with the carrier particles by means of the agitators 25, 26, and then is supplied to the developing sleeve 21. The two-component developer is a mixture including high resistive magnetic carrier particles having an average particle diameter of a few tenths of a μm and toner particles (colored resin powder) having an average particle diameter of a few μm~a few tenth μm, and can form a thin coating layer having a thickness of 20~100 mg/cm$^2$ by the aid of the regulating blade 24. The toner is charged with the polarity to develop the latent image by the regulated feeding by means of the regulating blade 24 and the friction between the toner and the carrier.

The toner density in the developer is detected by the toner density sensor 30 embedded in the compression member 29 and disposed near the regulating blade 24 just before the developer reaches the regulating blade 24.

Figure 3:
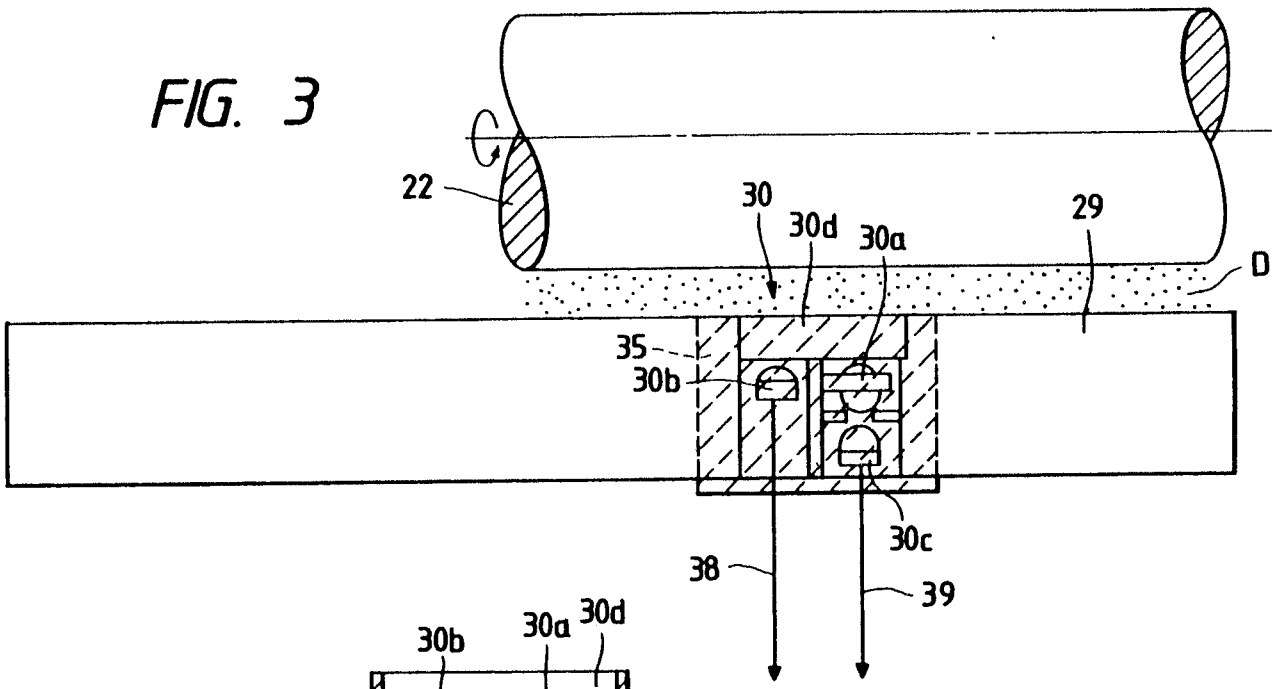
FIG. 3 is explanatory view for explaining a main portion of the apparatus of FIG. 2.

FIG. 3 shows the sensor in a cross-sectional view taken along the line C—C of FIG. 2. As shown in FIG. 3, the toner density sensor 30 is embedded into the developer compression member 29. The sensor 30 includes a light emitting element **30*a* (in this example, an LED emitting the infrared rays from on both sides), first and second light receiving elements 30*b*, 30*c* each acting as a photoelectric converting element for generating an electric signal in response to the received light amount, and a light permeable window (for example, glass, acrylic resin or the like) 30*d* arranged in confronting relation to the developing sleeve 22 and engaged by the developer carried by the sleeve 22 and advanced toward the blade 24**.

The density sensor 30 has a window **30*d*, which is located at a predetermined position in a plane substantially identical with the surface of the regulator 24 facing the developing sleeve 22. With this arrangement, it is possible to meet the requirements for quick transportation of the developer to the sensor surface 30*d*, adequately agitated and mixed conditions of developer on the sensor surface 30*d* and necessary quantity and uniform density of developer on the sensor surface 30d** for sending the toner concentration.

Particularly, since the sensor surface 30d of the sensor 30 is substantially identical to the surface of the regulator 24 facing the sleeve 22, an equal flow of developer can be obtained in the sensor area and other area. That is, it is possible to eliminate problems that may otherwise be posed when the sensor 30 is disposed near the developing sleeve 22.

The infrared ray light emitted from the front part of the LED 30a illuminates the developer D through the window 30d. The infrared ray light reflected by the developer D is received by the first light receiving element 30b through the window 30d. The first light receiving element 30b emits the electric signal corresponding to the received light amount which corresponds to the reflected light amount reflected by the developer D, and this reflected light amount corresponds to the toner density in the developer D, i.e., the weight of the toner particles per a unit weight of the developer. Accordingly, the output from the first light receiving element 30b corresponds to the toner density in the developer D, this output signal being supplied to the control circuit 34 through the lead wire 38, as mentioned above.

On the other hand, the infrared ray light emitted from the rear part of the LED 30a is received by the second light receiving element 30c. The second light receiving element 30c outputs the signal corresponding to the received light amount, this output signal being supplied as the reference signal to the control circuit 34 through the lead wire 39, as mentioned above. The control circuit 34 amplifies the signal by the difference between these two signal values and controls the motor 33 for driving the feeder 32, thus keeping the toner density in the developer D within a predetermined density range.

As explained above, the toner density sensor 30 is arranged in the vicinity of the regulating blade 24 to which the AC bias voltage is applied. And, a metallic conductive plate 35 made of aluminium, copper and the like is disposed between the blade 24 and the sensor 30. In the illustrated embodiment, the conductive plate 35 is bent in the L-shape to cover the area opposite to the window 30d of the sensor 30 and is electrically earthed or grounded through a lead wire 40.

Since the conductive plate 35 serves as an electrical shield member for the toner density sensor 30, it is possible to prevent the alternate current component of the bias voltage applied to the regulating blade 24 from affecting a bad influence upon the sensor 30, and thus, to prevent such alternate current component from entering or mixing to the output signal of the sensor 30 as the noise. Therefore, since it is possible to send the correct signal to the control circuit, accuracy of the control regarding the toner density in the developer can be improved.

Figure 4:
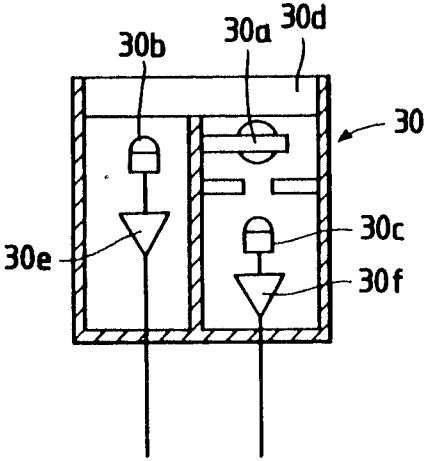
FIG. 4 is a sectional view of a toner density sensor applicable to the present invention.

Incidentally, in order to amplify the weak signals of the first and second light receiving elements 30b, 30c to be sent to the control circuit 34, as shown in FIG. 4, amplifying circuits 30e and 30f for amplifying such signals may be incorporated into the sensor 30. In the present invention, it is also possible to prevent the AC bias voltage from affecting the bad influence upon the amplifying circuits 30e, 30f.

Further, the light emitting element 30a may emit the visual light.

What is claimed is:

1. A developing apparatus comprising:

a developer bearing member for bearing developer including toner particles and carrier particles to feed the developer to a developing station;

a regulating member disposed in confronting relation to said developer bearing member and adapted to regulate an amount of the developer fed to said developing station;

a voltage source for outputting an alternating bias voltage, an output of which is applied to said developer bearing member and to said regulating member;

a detecting element disposed in the vicinity of said regulating member and in confronting relation to said developer bearing member and adapted to detect toner density in the developer born by said developer bearing member; and an electrical shield member disposed between said detecting element and said regulating member.

2. A developing apparatus according to claim 1, further including:

a first chamber in which said developer bearing member, regulating member and detecting element are disposed;

a second chamber for containing the toner particles to be replenished into said first chamber; and a control means for controlling the replenishment of the toner particles from said second chamber to said first chamber in response to an output signal from said detecting element.

3. A developing apparatus according to claim 2, wherein said detecting element comprises a light emitting element for emitting light onto the developer, and a light receiving element for receiving light reflected by the developer, and wherein said control means controls the replenishment of the toner particles on the basis of an output signal from said light receiving element.

4. A developing apparatus according to claim 3, wherein said detecting element includes an amplifying circuit for amplifying the output signal from said light receiving element, and wherein said control means controls the replenishment of the toner particles on the basis of an output signal from said amplifying circuit.

5. A developing apparatus according to any of claims 1 to 4, wherein said electrical shield member is electrically grounded.

6. A developing apparatus according to any of claims 1 to 4, further including a compression member disposed in confronting relation to said developer bearing member and adapted to compress the developer to be fed to said regulating member, and wherein said detecting element is embedded within said compression member.

7. A developing apparatus according to claim 6, wherein said electrical shield member is electrically grounded.

8. A developing apparatus according to claim 3 or 4, wherein said detecting element includes a window member wherein the light emitted from said light emitting element to the developer passes through said window member, wherein the reflected light directed from the developer to said light receiving element passes through said window member and wherein the developer born by said developer bearing member slidably contacts said window member.

9. A developing apparatus according to claim 8, wherein said electrical shield member is electrically grounded.

* * * * *

UNITED STATES PATENT AND TRADEMARK OFFICE

CERTIFICATE OF CORRECTION

PATENT NO. : 5,067,435

DATED : November 26, 1991

INVENTOR(S) : AKIHITO HOSAKA

It is certified that error appears in the above-identified patent and that said Letters Patent is hereby corrected as shown below:

IN [57] ABSTRACT

Line 13, "born" should read --borne--.

COLUMN 1

Line 53, "elements" should read --element--.

COLUMN 2

Line 31, "in" should read --to--.
Line 56, "as" should read --an--.

COLUMN 3

Line 15, "numerals" should read --numeral--.
Line 45, "is" should read --are--.
Line 61, "reference 32" should read --reference numeral 32--.
Line 63, "reference 33" should read --reference numeral 33--.

COLUMN 5

Line 50, "affecting" should read --effecting--.

UNITED STATES PATENT AND TRADEMARK OFFICE

CERTIFICATE OF CORRECTION

PATENT NO. : 5,067,435

DATED : November 26, 1991

INVENTOR(S) : AKIHITO HOSAKA

It is certified that error appears in the above-identified patent and that said Letters Patent is hereby corrected as shown below:

COLUMN 6

Line 15, "born" should read --borne--.
Line 63, "born" should read --borne--.

Signed and Sealed this

Fifteenth Day of June, 1993

*Attest:*

Michael K. Kirk

MICHAEL K. KIRK

*Attesting Officer*

*Acting Commissioner of Patents and Trademarks*